United States Patent [19]

Wetch et al.

[11] Patent Number: 4,875,529

[45] Date of Patent: Oct. 24, 1989

[54] ALTERNATE FORMS OF, SIDE DRIVE DRILLING

[75] Inventors: Stephen B. Wetch, Ventura; Gregory A. Goris, Oxnard; Igor Krasnov, Port Hueneme, all of Calif.

[73] Assignee: Varco International, Inc., Orange, Calif.

[21] Appl. No.: 133,174

[22] Filed: Dec. 11, 1987

Related U.S. Application Data

[63] Continuation of Ser. No. 820,776, Jan. 21, 1986, abandoned.

[51] Int. Cl.[4] ..... E21B 3/00

[52] U.S. Cl. ..... 173/163; 173/140

[58] Field of Search ..... 173/163, 164, 140, 151

[56] References Cited

U.S. PATENT DOCUMENTS

| | | | |
|---|---|---|---|
| 3,012,619 | 12/1961 | Farque | 173/140 |
| 3,857,450 | 12/1974 | Guien | 173/163 |
| 4,190,119 | 2/1980 | Loftis et al. | 173/163 X |
| 4,296,820 | 10/1981 | Loftis | 173/140 |

*Primary Examiner*—Frank Y. Yost
*Assistant Examiner*—William Fridie, Jr.
*Attorney, Agent, or Firm*—Joseph R. Dwyer

[57] ABSTRACT

Disclosed is a method and apparatus comprising a side drive system with a drive shaft (24, 24a) driven from the platform level (10) and powering a drilling unit (16) for rotating drill pipe (14). Except for the tethering of the drive shaft at the top of the derrick (60–64) and its coupling to a power source (70) at the platform level, there is preferably no stabilizing means for the system. The drive shaft (24, 24a) is stationary, preferably hollow, and extends the height of the derrick located to one side of the main drilling axis. The power source (70) at the platform level comprises a power takeoff from a conventional rotary table (84). The upper drive assembly (18) of the drilling unit (16) is coupled to the drive shaft (24, 24a) and capable of vertical movement along the drive shaft and providing torque to the drill string. As an option, a stabilizing system for the drilling unit in the form of tension members (182) may be used, or the drive shaft itself may be stabilized at various elevations along its length by stabilizing arms (190) to provide lateral bending restraint yet permitting rotational freedom. The preferred embodiment is such that the side drive system may operate without stabilizing mechanisms for the drilling unit or drive shaft.

15 Claims, 9 Drawing Sheets

ALTERNATE FORMS OF, SIDE DRIVE DRILLING

This is a continuation of application Ser. No. 820,776, filed Jan. 21, 1986, now abandoned.

RELATED APPLICATIONS

U.S. patent application entitled "Side Drive Drilling," Ser. No. 762,507, filed 8/5/85 by Igor Krasnov, and U.S. patent application entitled "Easy Break-out Tool and Method," Ser. No. 805,664, filed Dec. 6, 1985 by Gregg Goris and Igor Krasnov.

U.S. patent application entitled "Gate Valve," Ser. No. 763,728, filed Aug. 8, 1985 by Igor Krasnov.

BACKGROUND OF INVENTION

This invention relates to the drilling of oil and gas wells, offshore and onshore, and is particularly directed to a method and apparatus which is an improvement of, or an alternate to, as the case may be, the side drive drilling apparatus and method of the Krasnov application, supra.

The side drive drilling system of the Krasnov application, which facilitated handling, drilling with triple pipe sections (approximate 90 foot lengths), and back reaming, has essentially the following features:

1. an elongated, axially stationary, drive shaft, referred to as a "kelly" therein, extending essentially the height of the derrick and rotated by a motor located near the platform level, 2. the drive shaft is located to one side of and substantially parallel to the main or drilling axis in the derrick, 3. a bushing driven by the drive shaft, as part of the drive assembly for the drilling unit, movable vertically on the drive shaft and rotated thereby, 4. a rail system: for guidance of the drilling unit as it moves vertically for drilling and reaming, and 5. apparatus to facilitate handling heavy casing.

The apparatus and method of this invention, in its preferred embodiment, comprises a side drive system with a vertical drive shaft driven from the platform level and powering a drilling unit for rotating drill pipe. Except for the tethering of the drive shaft at the top of a derrick and its coupling to a power source at the platform or drill floor level, there is no stabilizing means for the system. Thus, the preferred embodiment of this side drive system has the following features and available options:

1. all the features of the side drive drilling system of the Krasnov application, supra, but without the guide rails of the Krasnov system;

2. utilizes the conventional rotary table as the power source (lower drive assembly) for rotating the drive shaft;

3. utilizes a hollow drive shaft to increase the lateral natural frequencies of the drilling system;

4. utilizes a torque balanced upper drive assembly to minimize unequal forces and torques imparted to the drive shaft that would cause excessive shaft deflections; and 5. may use a stabilizing system for the drilling unit or the drive shaft itself as an option.

In either the side drive system of the Krasnov application, supra, or the side drive system of this invention, the gate valve of the Krasnov application and or/the easy break-out tool of the Goris and Krasnov application may be used as still other options in practicing this invention.

SUMMARY OF THE INVENTION

The apparatus and method of this side drive system comprises a vertically disposed, axially stationary, preferably hollow, drive shaft, extending substantially the height of the derrick, located to one side of the main or drilling axis, and rotated by a power takeoff from the existing conventional rotary table. The drive shaft is coupled only near the top of the derrick and coupled only at the bottom to a lower drive assembly (rotary table and a power takeoff therefrom). The upper drive assembly of the drilling unit is connected to the drive shaft and capable of vertical movement along the drive shaft for providing torque to the drill string. As an option, if desired, a stabilizing system for the drilling unit in the form of tension members (guide wires under tension), preloaded toward the drilling unit, may be used, or the drive shaft itself may be stabilized at various elevations along its length to provide lateral bending restraint, yet permitting rotational freedom. In the preferred embodiment of the invention, the drive and the driven mechanisms (chain sprocket, belt pulley, or gear) of the upper drive assembly are selected so that the side drive system will operate without stabilizing mechanisms.

It will be clear from the following Drawings and Detailed Description that;

1. the concept of the rail-less side drive system may be practiced with a separate drive shaft motor drive as in the Krasnov application, supra;

2. the lower drive assembly itself has other uses than simply to drive the drive shaft in the manner of this invention, for example, to drive other tools such as drill pipe or casing tongs and the like;

3. the drive shaft itself, which is shown in sections and hollow, may be one piece and/or solid rather than hollow, but if in sections, may be connected together in a manner other than that shown and described; and 4. the one-to-one ratio for the drive and driven units for the upper drive assembly may vary yet perform the desired function.

DETAILED DESCRIPTION

As used herein:

"drilling system" means the entire system for drilling a well, i.e., the derrick, traveling block, drill pipe string, rotary table, etc.;

"upper drive assembly" means the drive element powered by the drive shaft to drive a driven element, whether a sprocket chain drive, a pulley belt drive, or a gear as part of a drive train, which is connected to rotate a drill pipe string;

"drive" and "driven" elements in the upper drive assembly are used somewhat interchangably herein, inasmuch as the element driven by the drive shaft is also the drive element for the driven element (a power takeoff) which, in turn, is the drive element for the drilling unit to impart torque to the drill string.

"drilling unit" means all the equipment near the upper drive assembly, such as the elevator, swivel, etc. which are raised and lowered by the traveling block: and "lower drive assembly" includes the rotary table and the power takeoff to rotate the drive shaft, whether a sprocket chain drive, a pulley belt drive, or a gear as part of a drive train, which uses the rotary table as the power source.

Figure 1:
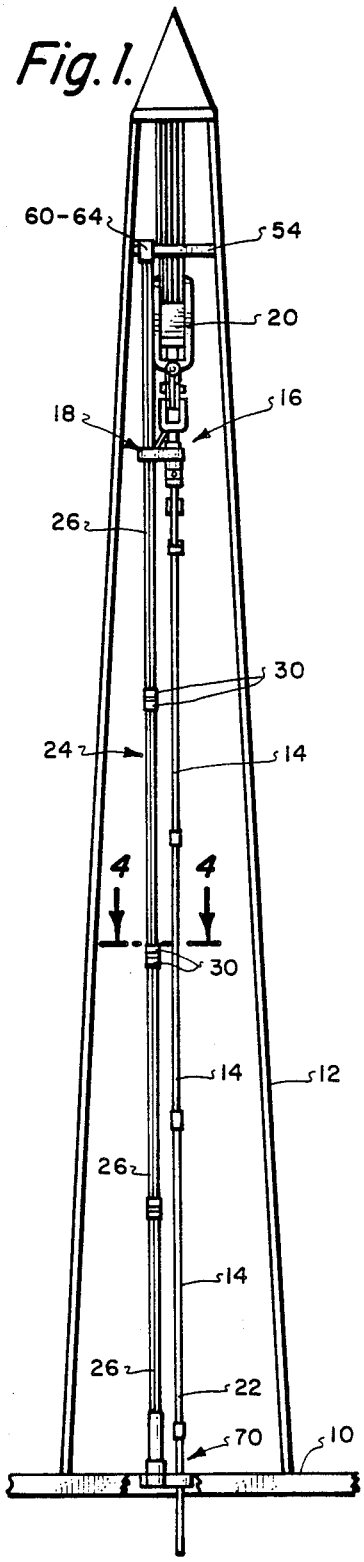
FIG. 1 is an elevational view of a typical derrick located on a platform and incorporating the side drive system of this invention.

FIG. 1 illustrates a platform 10 on which a derrick 12, of the conventional type and size, is supported for drilling and reaming operations to be conducted. Located within the derrick are three sections of drill pipe 14 connected together as unit above the platform, illustrating the manner in which drilling or reaming in triples is accomplished, as described in the Krasnov application, supra. The line of travel of a drilling unit 16 with its upper drive assembly 18 and rotational axis of the drill pipe are in the center line of the derrick and moved vertically by a traveling block 20 in the conventional manner. This center line is the main, or drilling, axis and denoted as 22. The platform 10 and derrick 12 may be located on a floater (i.e., ship or semi-submersible) or a offshore platform (stationary or movable) for drilling a well, or may be part of a land based rig for drilling an onshore well. An easy break-out tool (though not shown) may be used to insure the proper break-out of three drill pipe lengths to facilitate triple drilling and reaming. Such an easy break-out tool and how it is connected into a side drive drilling system is disclosed and claimed in the Goris and Krasnov application, supra, to which reference may be made. Also, a remotely operated upper kelly cock valve can be used in the system to shut off drilling fluid above break-out tool and below the swivel. See the Gate Valve disclosed and claimed in the Krasnov Application, supra.

Figure 2:
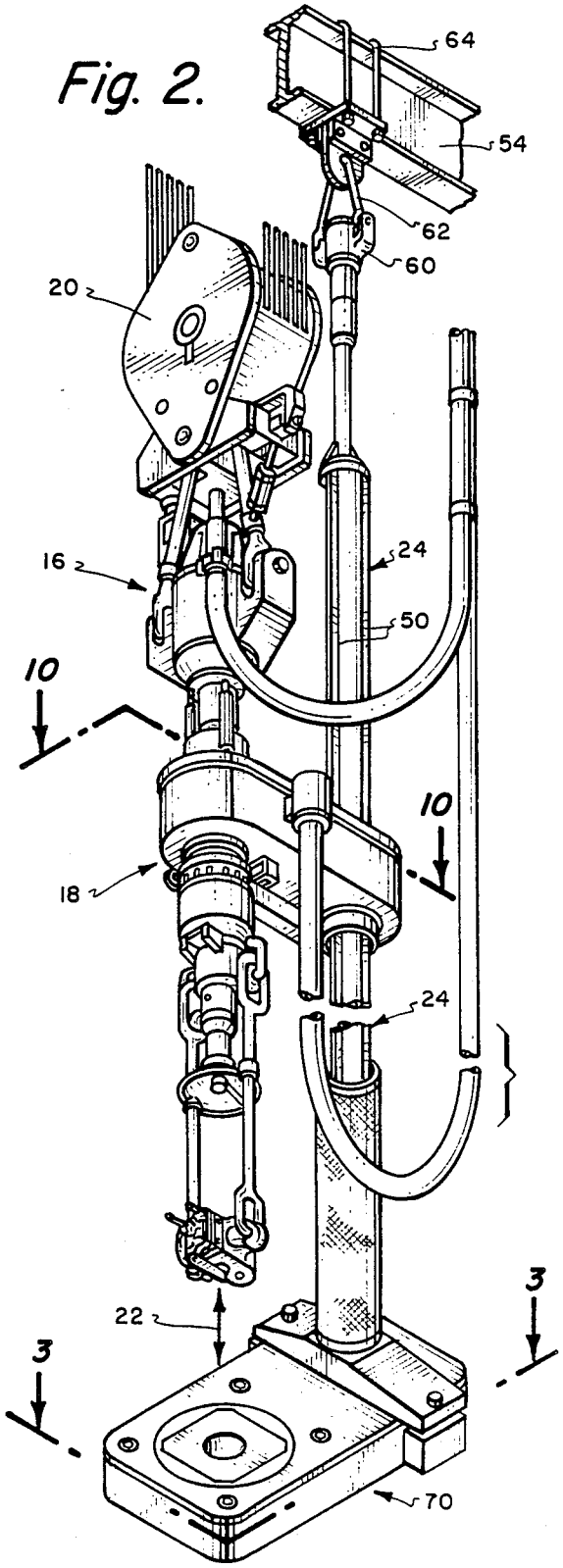
FIG. 2 is an enlarged view of the side drive system shown in FIG. 1, illustrating the vertical, stationary, rotatable drive shaft, journaled at the top of the derrick and coupled to a lower drive assembly.
Figure 4:
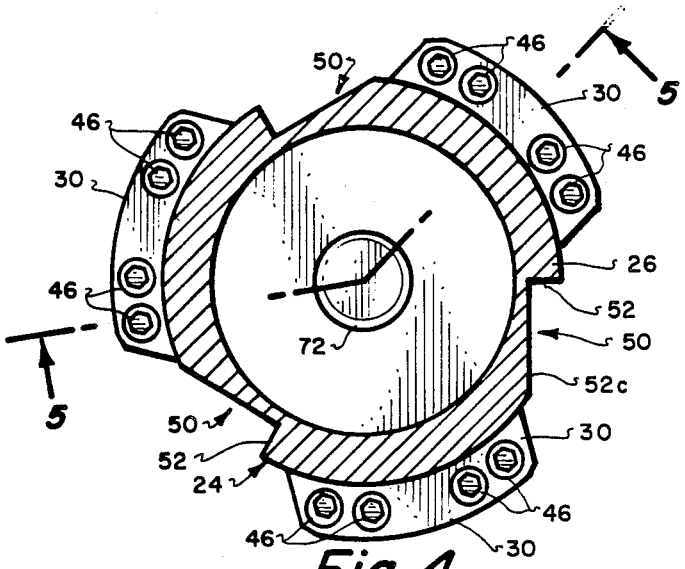
FIG. 4 is a cross-sectional view of the drive shaft, taken along line 4—4 of FIG. 1.
Figure 5:
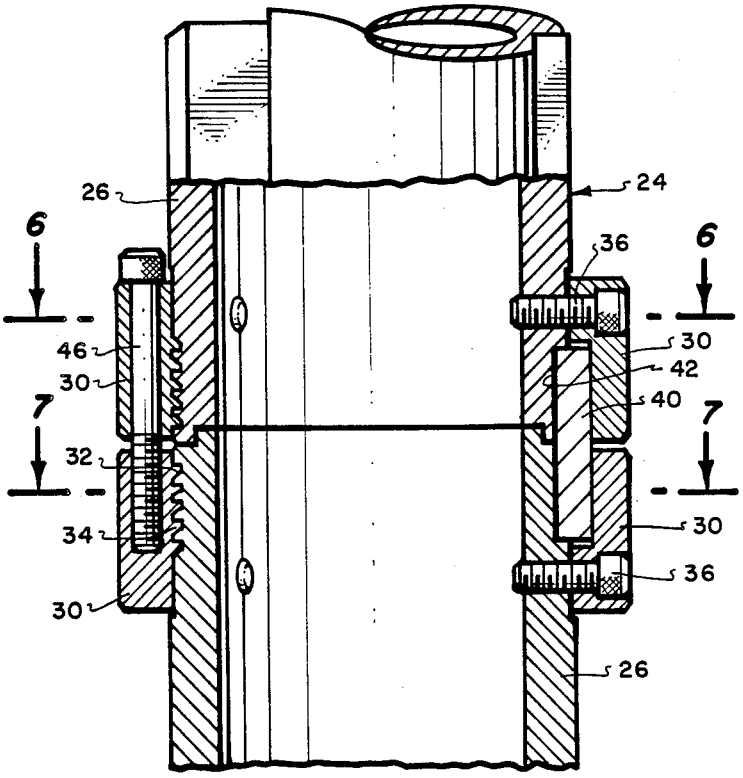
FIG. 5 is an elevational view of the means for connecting the sections of the drive shaft, partly in section and taken line 5—5 of FIG. 4, FIGS. 6 and 7 are cross-sectional views of the drive shaft coupling taken along lines 6—6 and 7—7, respectively, of FIG. 5.
Figure 6:
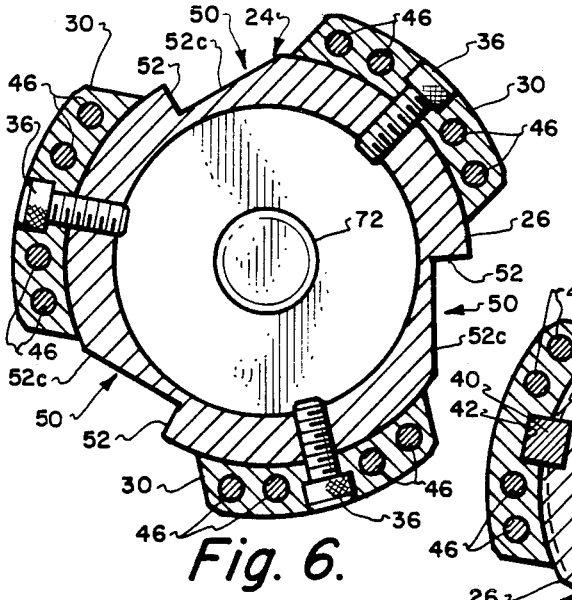
Figure 7:
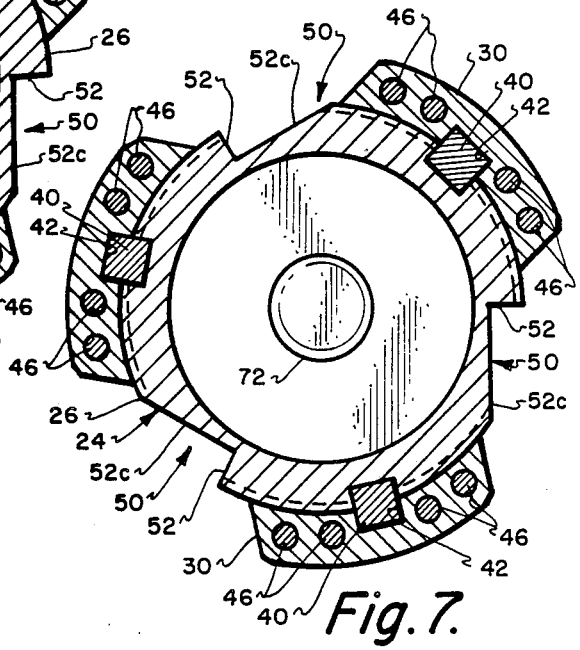

As shown in FIGS. 1 and 2, there is an elongated tube, referred to as a drive shaft and denoted as 24. As shown in FIGS. 1, and 4–8, this drive shaft is made up of a plurality of sections 26 comprising a tubular member with attached coupling flanges segment 30 (six for each section) for connecting one section to another to form the long drive shaft extending essentially from the height of the derrick. Each flange segment 30 is internally grooved at 32 to engage complementary groove 34 on each end of the tubular member and is attached to the tubular member by radially disposed bolts 36. Keys 40 and key slots 42 in the flange segments 30 are used to transmit torque between the tubular members. The flange segments are also longitudinally bolted together as at 46 to connect the sections together. As clearly shown in FIGS. 4 and 5, these flange segments are spaced apart circumferentially of the tubular member with longitudinal grooves 50 formed in the tubular member itself between each spaced apart flange segment for the application of torque to the upper driving assembly 18 forming part of the drilling unit 16, in a manner to be described. The spacing between the flange segments as shown in FIG. 4 allows the drilling unit 16 to move freely along the length of the drive shaft 24.

As shown in FIGS. 1 and 2, the drive shaft 24 is toggled, or journaled (sometimes also referred to as tethered), at its upper end on one of the cross beams 54 of the derrick 12 and is located to one side and is generally parallel to the main drilling axis 22. The journal at the upper end of the drive shaft 24 is shown as a housing 60 containing a suitable bearing and connected to the cross beam 54 by a bail 62 and beam clamp 64, although any suitable connecting means and bearing means to journal the upper end of the drive shaft 24 may be used.

Figure 8:
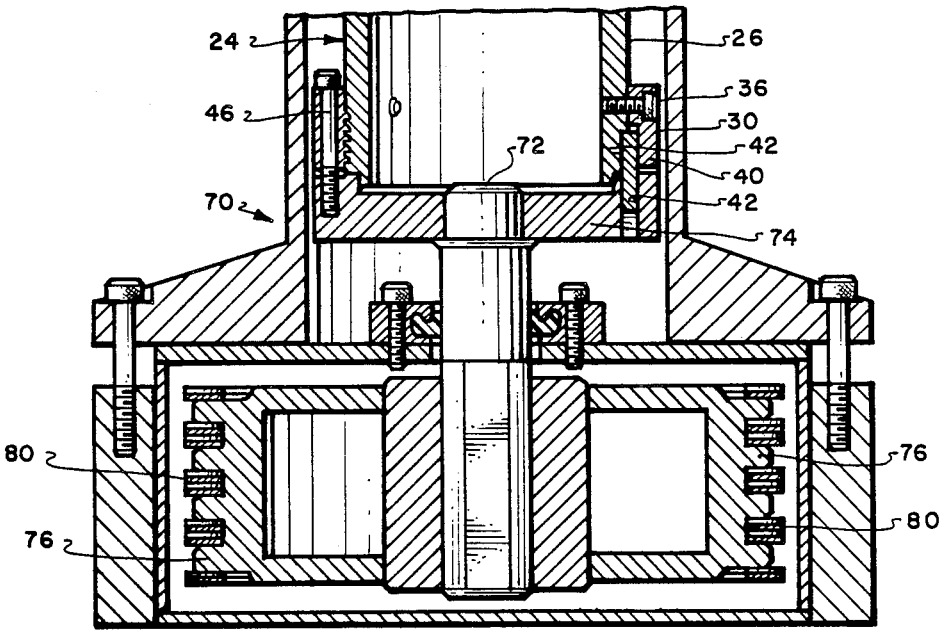
FIG. 8 is a cross-sectional view, taken along line 8—8 of FIG. 3, showing the means for connecting the lower drive assembly to the drive shaft.

As also shown in FIGS. 1 and 8, the drive shaft 24 is connected at its lower end to a lower drive assembly 70 for rotating the drive shaft (see FIG. 8). To make the connection to the lower drive assembly 70, the lowermost coupling flange segment 30 of the lowermost tubular member 26 is coupled to a driving flange 72, by the use of a key 40, key slot 42, and longitudinal bolts 46 in a manner similar to the connections between the tubular members themselves. This driving flange 72 is coupled for rotation to a vertical driven shaft 74. The shaft 74 is splined to a driven chain sprocket 76 rotated by a sprocket chain 80. Suitable seals and bearings are located where necessary for the proper operation of this lower drive assembly.

Figure 3:
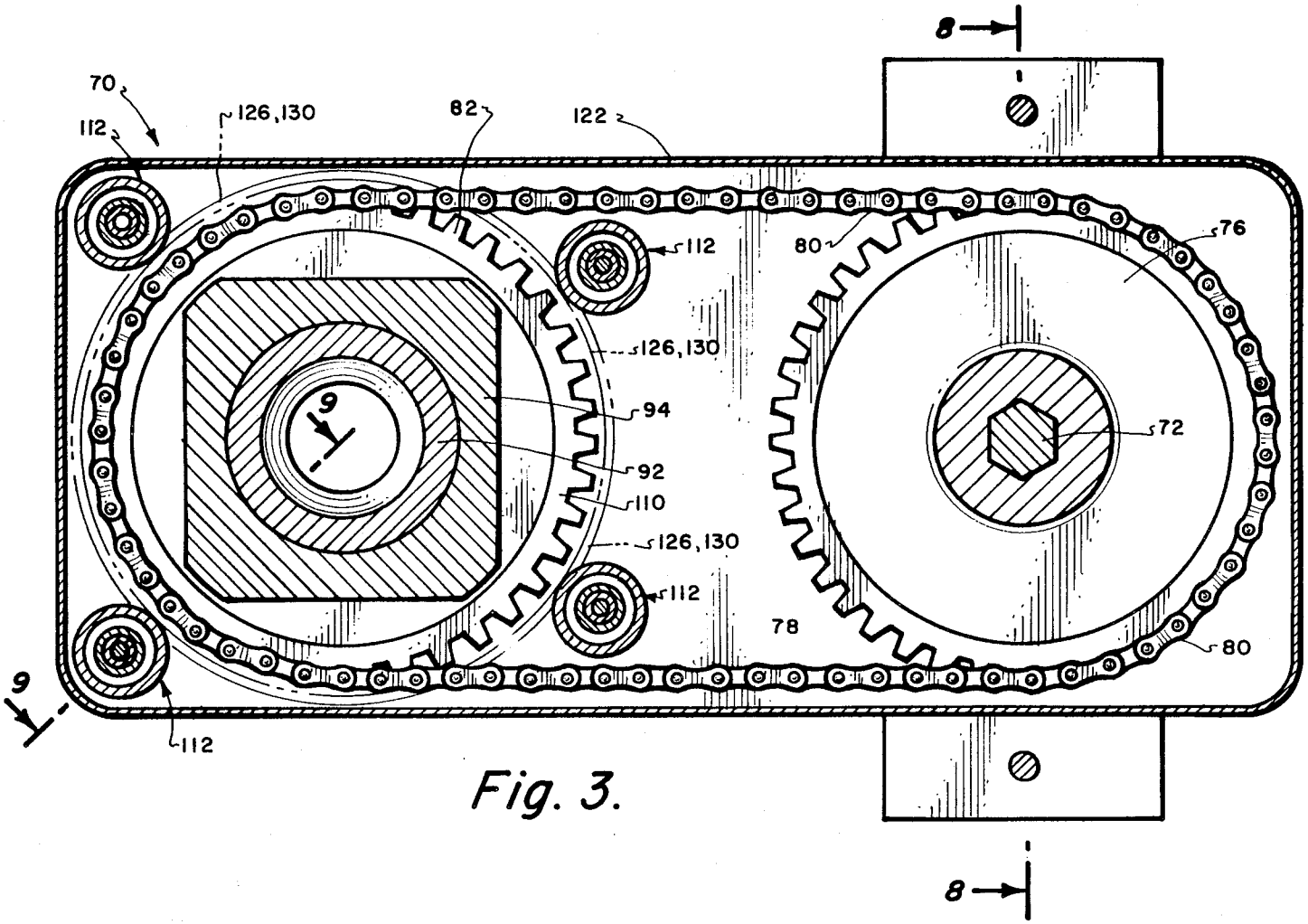
FIG. 3 is a plan view of the lower drive assembly, i.e., a power takeoff from the rotary table as shown in FIG. 2 with the cover removed (taken along line 3—3 of FIG. 2)
Figure 9:
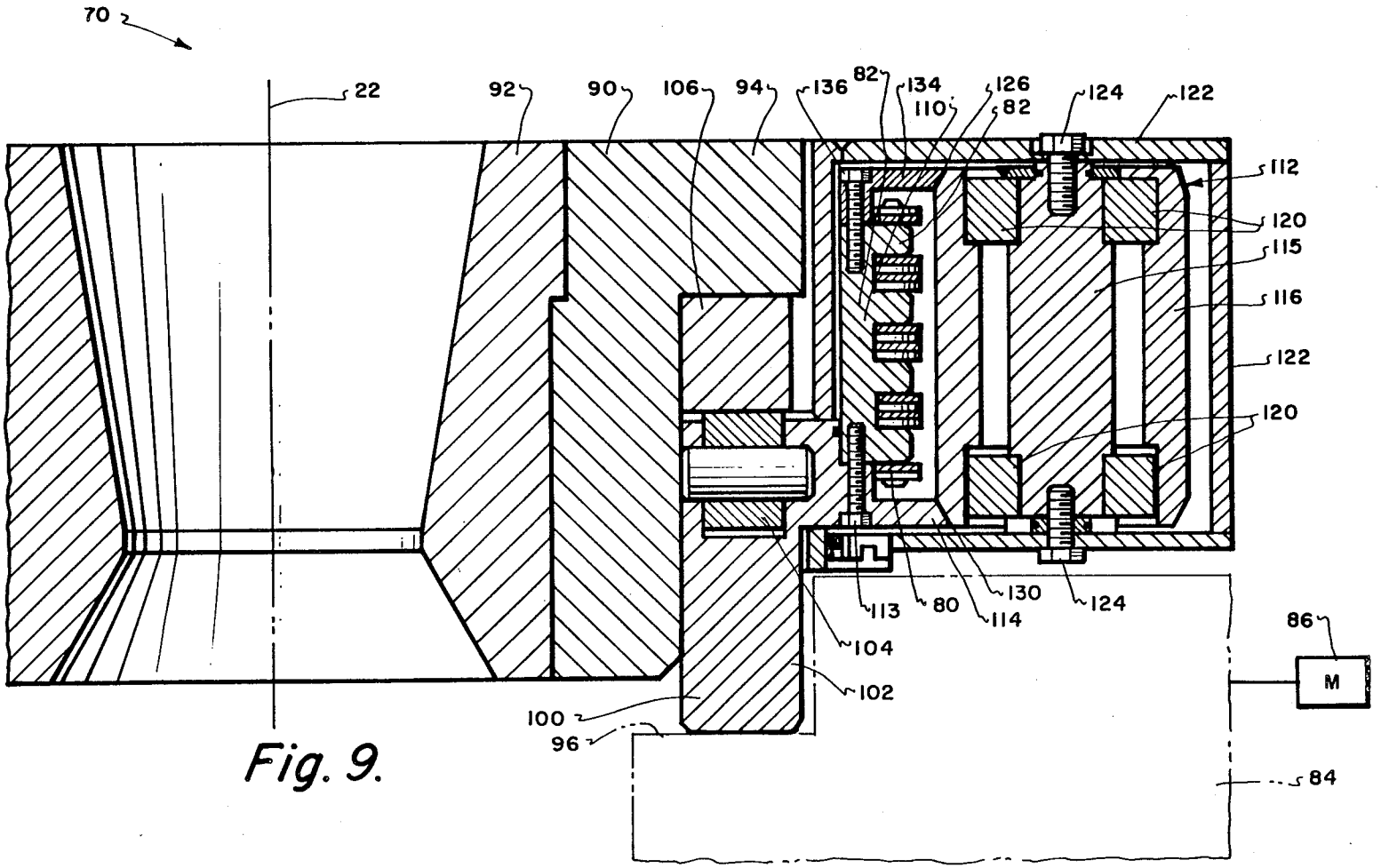
FIG. 9 is a cross-sectional view taken along line 9—9 of FIG. 3, showing the manner of connecting the lower drive assembly to a rotary table.
Figure 10:
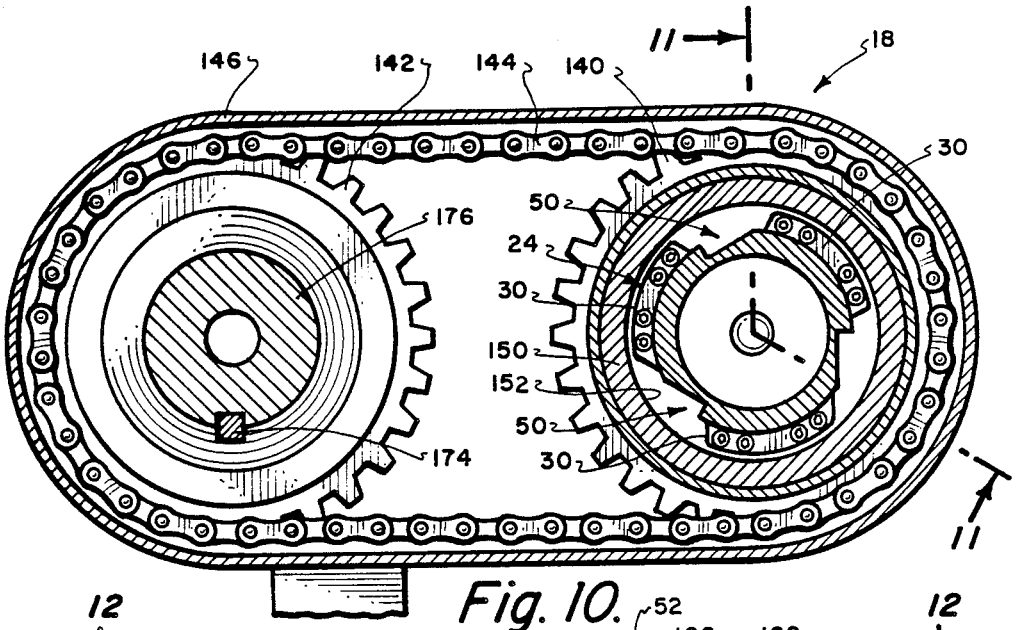
FIG. 10 is a plan view in cross-section of the upper drive assembly, taken along line 10—10 of FIG. 2
Figure 11:
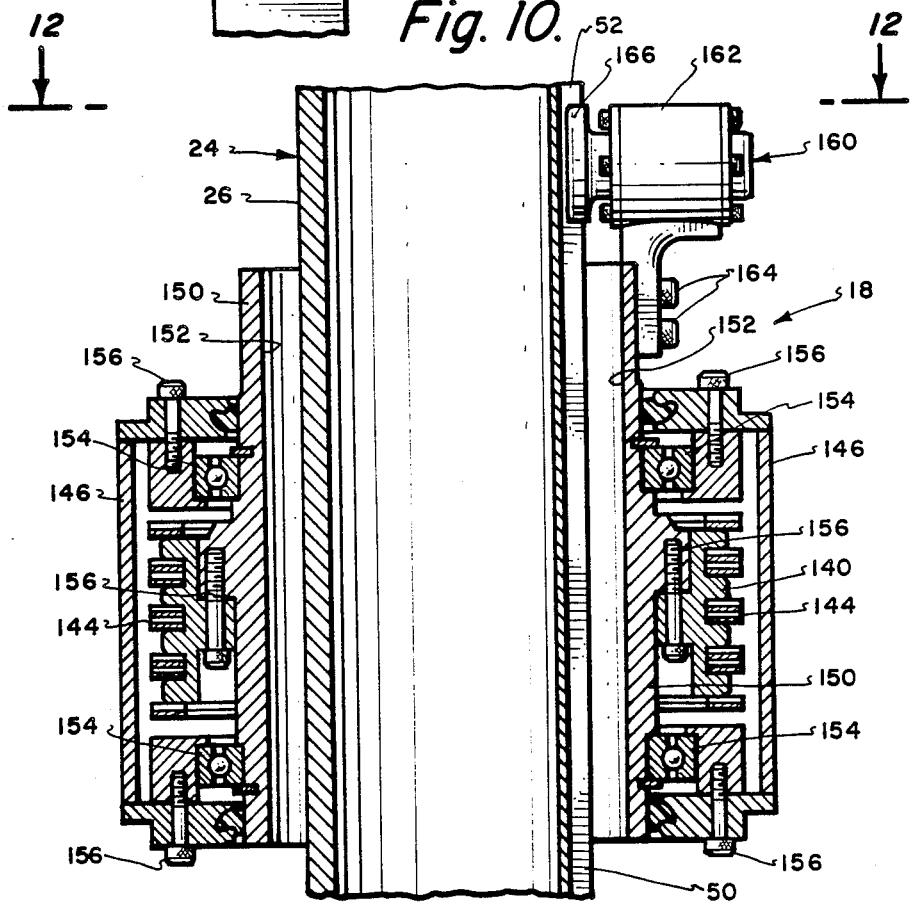
FIG. 11 is an elevational, cross-sectional view taken along 11—11 of FIG. 10.
Figure 12:
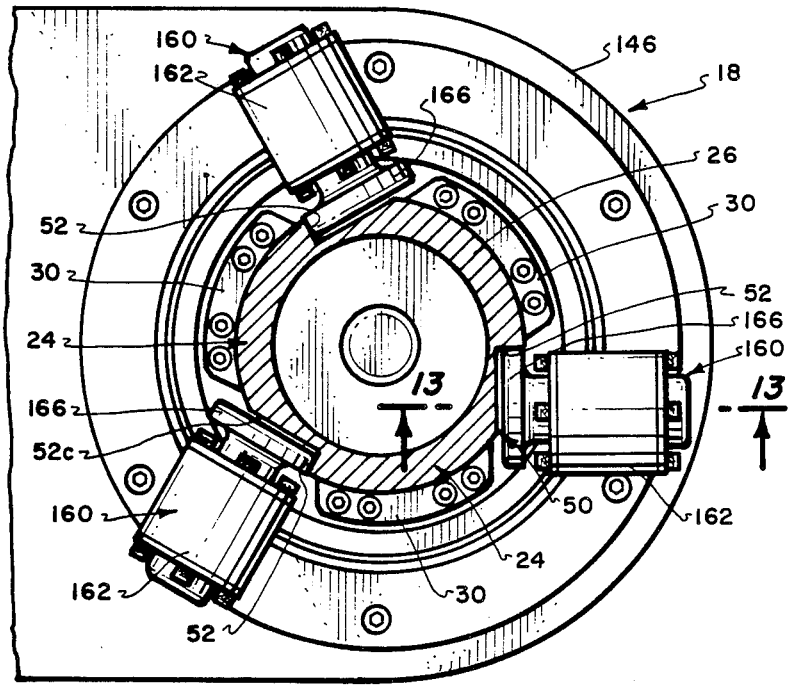
FIG. 12 is a top plan view, partly in cross-section, showing the means for connecting the upper drive mechanism to the drive shaft.
Figure 13:
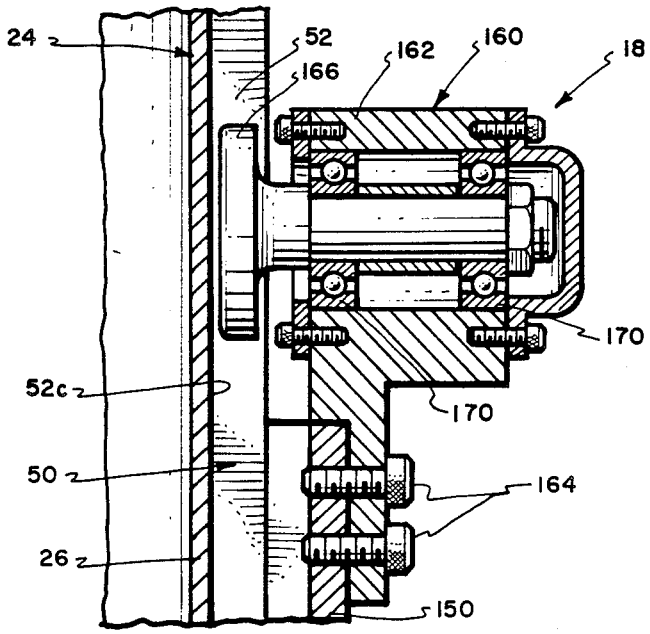
FIG. 13 i an elevational cross-sectional view taken along line 13—13 of FIG. 12 and showing one roller for connecting the upper drive assembly to the drive shaft.

As shown in FIGS. 3 and 9, the sprocket chain is coupled to a drive sprocket 82. This drive sprocket 82 is coupled and rotated by the conventional rotary table 84 and, to make this coupling to the rotary table 84, attention is specifically directed to FIG. 9. The rotary table is driven by a motor 86 of the conventional type, shown only schematically. Normally, the conventional master bushing 90 and slip 92 would be located to be driven directly by the rotary table. To do this, the square flange 94 of the master bushing 90 would be placed in the square socket 96 of the rotary table 84. The master bushing flange and rotary table socket are only partially shown herein. Alternatively, the master bushing 90 would be connected to the rotary table by pins. Both types of master bushing/rotary table couplings are conventional. As shown in FIG. 9, however, the master bushing 90 and slip 92 have been raised out of the rotary table square socket 96 and placed on an intermediate drive mechanism 100. This intermediate drive mechanism 100 is formed with a square coupling 102 or pins, as the case may be, to couple to the rotary table and includes a plurality of horizontally disposed rollers 104 which engage a spacer ring 106 which, in turn, engages the square shoulder 94 of the master bushing. (Whether or not the master bushing and slip rotate is not material to the operation of this drive assembly since the bushing is simply to be used to accommodate the slips for holding the drill pipe in the conventional manner and is the opening through which the drilling operations take place.) This intermediate drive mechanism 100 is mechanically coupled to a drive sprocket 110, in the embodiment shown, by bolts 113 through a flange 114 and threaded into the drive sprocket 110. Thus, rotation of the intermediate drive mechanism 100 will also rotate the drive sprocket 110 and the aforementioned driven sprocket.

The sprocket 110 is stabilized to rotate about the center line or main axis 22 by a plurality of rollers 112 (four partially shown in FIG. 3), for rotation about the central axis 22. These rollers 112 each have a vertical stationary main shaft 115 and an outer roller 116 journaled on the main shaft 115 by roller bearings 120. The main shaft is also fixed to an outer housing 122 by bolts 124. Each outer roller engages bearing surfaces 126 and 130. Bearing surface 126 is the radially outer edge of a flat ring 134 attached to the top of sprocket by bolts 136, while bearing surface 130 is the radially outer edge of flange 114. Thus, the rollers 116 are the means for stabilizing the rotational axis of the drive sprocket 110. Rotation of the drive sprocket 110 by the rotary table 84 drives the drive chain 80 connected to and surrounding the driven sprocket 78 in line with the drive shaft and onto which the drive shaft is coupled for rotation.

Thus, the rotatable drive shaft 24, journaled only at its upper end and coupled to the lower drive assembly 70, rotates the upper drive assembly 18 of the drilling unit 16 in a manner now to be described.

Turning now to FIGS. 10–13, the upper drive assembly 18 is seen to comprise a pair of drive and driven sprockets 140 and 142, coupled by a sprocket chain 144 and located within a suitable housing 146 and preferably rotatable in the same direction. The drive sprocket 140 surrounds a sleeve 150 and the drive shaft 24. The sleeve 150 has an opening 152 sufficient to allow the coupling flange segments 30 to pass therethrough as the drilling unit is moved up and down by the traveling block 20 and is journaled by roller bearings 154 to the housing 146. Suitable seals are provided between the sleeve 150 and the housing as shown. The drive sprocket 140 is coupled to the sleeve 150 by bolts 156 and the sleeve 150 is coupled to the drive shaft 24 by a plurality of radially disposed bearing units 160 whose housings 162 are bolted at 164 to the sleeve 150. Rollers 166 are journaled in ball bearings 170 in the housing 162 and extend radially to engage the grooves 50 in the drive shaft 24 so that rotation of the drive shaft will impart torque to the drive sprocket 140 and, ultimately, to the driven sprocket 142 which is keyed 174 to a spindle shaft 176 within the drilling unit. The spindle 176 is conventional and forms part of the drilling unit more completely shown in FIG. 2. The grooves 50 and the positioning of the rollers 166 are such that when the drive shaft is transmitting right hand (clockwise in FIGS. 10 and 12) torque rolling contact is made between drive shaft vertical radial side walls 52 of grooves 50 and rollers 166 of the upper drive assembly. This allows the drilling unit to be raised and lowered while transmitting power for drilling. Reverse torque is transmitted between flat surfaces of rollers 166 against bottom surfaces 52*c* of the grooves 50.

Thus, a rail-less side drive system has been described utilizing a power takeoff at the platform level which is shown driven by a conventional rotary table lower drive assembly 70. This lower drive assembly 70 is shown as a sprocket chain drive although a pulley belt system or a gear train may be used, once having understood the concept of deriving the power from the rotary table. Also, insofar as the upper drive assembly 18 is concerned, while a sprocket chain drive is shown, a belt drive or a gear train may also be used. In the embodiment shown, the ratio of the upper drive and driven sprocket is within ten per cent of one-to-one so that there is no additional side or rotational force from unequal torque. Too, in this system, the speed of rotation of the drive shaft and drill string is controlled (reduced or increased) if and when natural frequency resonance starts and isolation damping is used between vibrating structures.

Further, while the drive shaft is shown with grooves 50 within its side wall, other configurations may be used, some of which will be shown in the following described figures.

Figure 14:
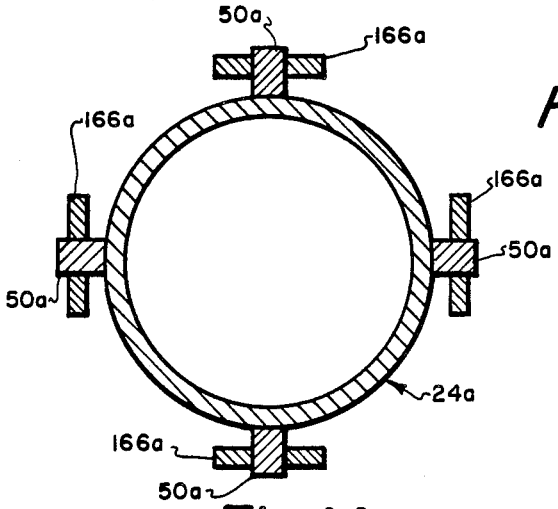
FIG. 14 is a cross-sectional view of another embodiment of a drive shaft utilizing torque flanges.

Thus, if desired, the drive shaft may take the form of a hollow pipe 24*a* as shown in FIG. 14, whether or not sectionalized and flanged in any suitable manner, with a plurality of torque ribs 50*a* extending radially therefrom, which will be engaged by rollers 166*a* for imparting torque to the upper drive element 18*a*. The pipe, ribs and rollers are given the same reference numbers as those components which perform a similar function in the previous figures to simplify the description.

Figure 16:
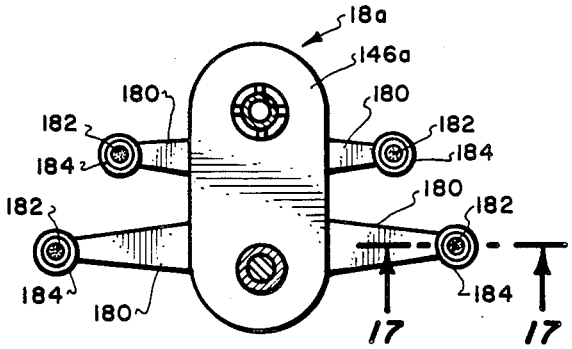
FIG. 16 is a top plan view of the means for connecting the upper drive assembly to the stabilizing means of FIG. 15, and taken along line 16—16 of FIG. 15.
Figure 17:
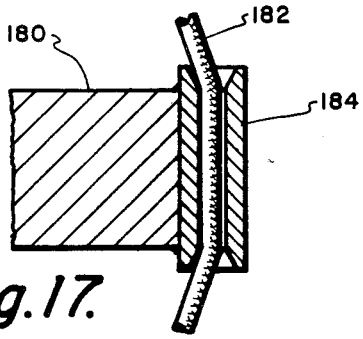
FIG. 17 is an elevational cross-sectional view taken along line 17—17 of FIG. 16 showing one connection of the upper drive assembly to the stabilizing means.
Figure 15:
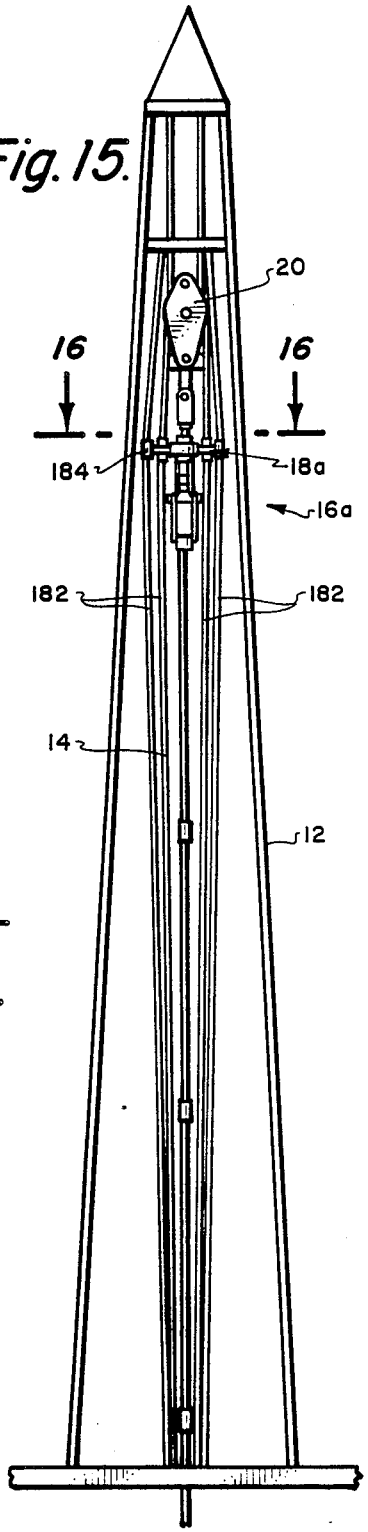
FIG. 15 is an elevational view of the side drive system showing one option for stabilizing the drilling unit and drive shaft.

As also mentioned previously, if it is desired to stabilize the drilling system one example of such stabilizing means is shown in FIGS. 15, 16 and 17 where guide arms 180 extend from the housing 146*a* of the upper assembly 18*a* to cooperate with tension wires 182, extending from the top of the bottom of the derrick, and preloaded toward the drilling unit to stabilize the drilling unit 16*a* as it moves vertically within the derrick 12. This configuration provides a radial preload toward the drilling unit. FIG. 17 illustrates in detail how the guide wires 182 would be journaled in a sleeve 184 at the end of each of the guide arms 180. Again, the components which function similar to those in the previous figures are given the same reference numerals but with the suffix "a". Note that the second form of the drive shaft, i.e., drive shaft 24*a* is shown in these figures.

Figure 18:
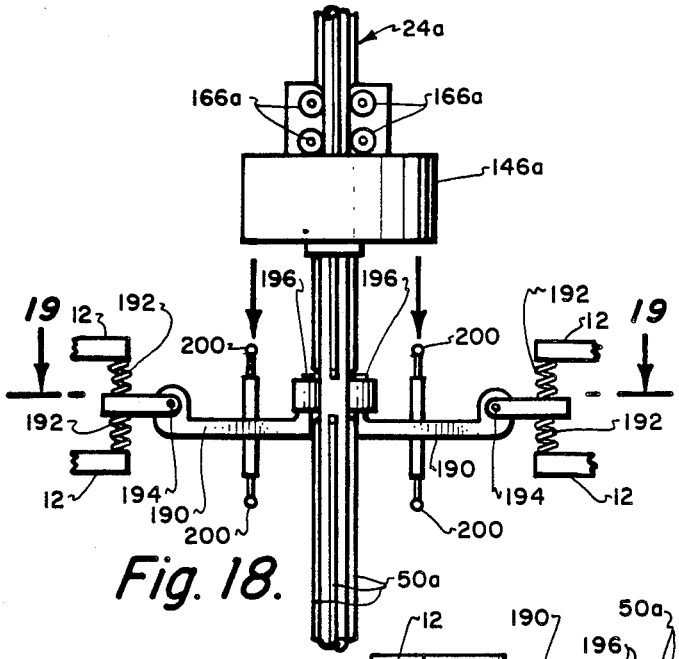
FIG. 18 is a schematic illustration, in elevation, showing another option for stabilizing the system by engaging the drive shaft itself.
Figure 19:
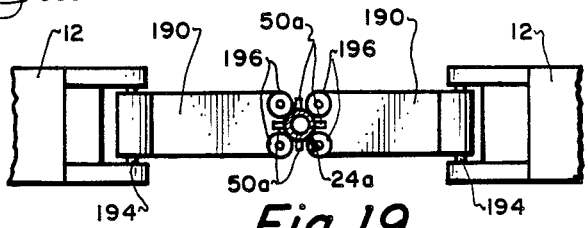
FIG. 19 is a top plan view taken along line 19—19 of FIG. 1.
Figure 20:
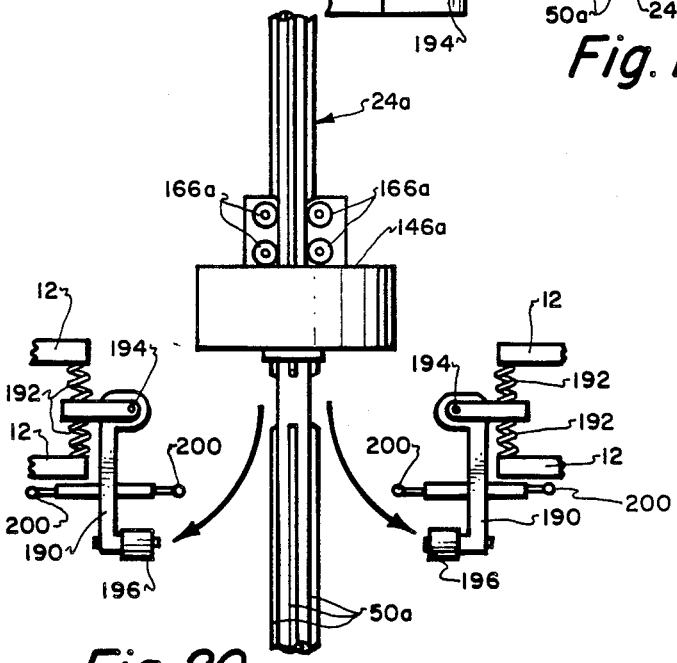
FIG. 20 illustrates how the stabilizing means enables the drilling unit to travel vertically of the drive shaft.

As another example of a means of stabilizing the drilling system, FIGS. 18–20 illustrate guide arms 190 connected to the derrick 12 in any suitable manner as by springs 192, and pivoted as at 194 so as to be movable away from the upper drive assembly 18a as the latter is moved upward and down on the drive shaft 24a. The guide arms 190 are spring biased at the pivotal joint 194 toward a horizontal position as shown in FIG. 18 and the inner extremity of the guide arms 190 contain rollers 196 which engage the drive shaft 24a. Midway on the guide arms 190 there is provided schematically illustrated bumpers 200 which engage the housing 146a, pivot the guide arms 190 in the direction of movement of the housing to allow passage of the housing. Thereafter, the arms will reengage the drive shaft 24a, and reengage the drive shaft. Several of these stabilizing mechanisms would be utilized throughout the length of the drive shaft, depending on the needs envisioned by the operator, and since the drive shaft shown is the type illustrated in FIG. 14, the ribs 50a are removed at certain points along the drive shaft so as to not interfere with the rollers 196.

We claim:

1. In a rail-less system for drilling oil and gas wells, having drilling means, a platform with an opening through which drilling operations may be conducted, and a derrick on said platform centered over said opening, the improvement comprising;

drive means located at the platform, an elongated rod means whose top end is tethered on said derrick and whose bottom end is connected to be rotated by said drive means but is otherwise unconnected to said derrick, said elongated rod being parallel to the center of said opening and center line of said derrick, driven means responsive to the torque applied to said elongated rod by said drive means and movable vertically on said elongated rod means to apply torque to said drill means whereby drilling operations may be carried out through said opening, said driven means including first rotatable means connected to said elongated rod means but otherwise unconnected to said derrick and a second rotatable means connected to said first rotatable means with the drive ratio of substantially 1:1 to avoid excessive deflections of said drilling means and eliminate the need for rails on said derrick and such that the diameters of said first rotatable means and said second rotatable means are equal and the direction of rotation is the same between the two rotatable means, and wherein said drive means located at the platform includes;

a first drive means and a rotary table, said first drive means being connected to and rotatable by said rotary table, and a second driven means connected to and rotatable by said first drive means and connected to said elongated rod means.

2. The system as claimed in claim 1 wherein said first drive means surrounds said opening and wherein said second driven means is located to one side and coaxial with said elongated rod means.

3. The system as claimed in claim 2 wherein said elongated rod means is hollow.

4. The system as claimed in claim 2 wherein said elongated rod means is hollow and comprises a plurality of sections connected together.

5. The system as claimed in claim 2 wherein said drilling means comprises more than one drill pipe section connected together as said rotatable driven means is imparting torque thereto.

6. The system as claimed in claim 5 wherein said rotatable drive means has torque imparted to said elongated rod by roller means.

7. The system as claimed in claim 6 wherein said elongated rod means is a drive shaft and wherein said rotatable driven means is connected thereto by rollers movable vertically on said drive shaft.

8. The system as claimed in claim 7 wherein said drive shaft is provided with vertical grooves engagable by rollers.

9. The system as claimed in claim 8 wherein said drive shaft is provided with radial means engagable by rollers.

10. The system as claimed in claim 9 further including stabilizing means for stabilizing said drilling means.

11. The system as claimed in claim 10 wherein said stabilizing means comprises wire ropes connected near the top of said derrick and near or at the platform and guide arms cooperating with said wire ropes and drilling means.

12. The system as claimed in claim 9 wherein said stabilizing means comprises guide arms engaging said drive shaft at selected places along its length.

13. A power source mechanism for use on a gas or oil well drilling or production rig for imparting torque to any driven element such as a drive shaft, power tong, or the like, having a rotary table with a master bushing therein comprising, an intermediate drive mechanism between said master bushing and rotatable connected to said rotary table including, means for connecting said intermediate drive mechanism to said rotary table for rotation of said intermediate drive means, means connecting said intermediate drive means to a drive means, and driven means, connected to and rotated by said drive means, and having connecting means for rotating a driven member thereby.

14. The mechanism claimed in claim 13 wherein said intermediate drive mechanism includes means insertable in a socket in said rotary table normally used by said master bushing, and means providing independence of said master bushing of said rotary table from rotation thereby.

15. In a rail-less system for drilling oil and gas wells having drilling means, a platform with an opening through which drilling operations may be conducted, and a vertically extending derrick on said platform over said opening and having means for moving said drilling means vertically t aid opening, the improvement wherein said drilling means is torsionally and radially independent of the derrick thereby eliminating the need for reaction means such as rails on said derrick which comprises;

a vertically extending elongated rotatable rod means whose top end is tethered on said derrick and whose lower end is connected to be rotated y a drive means, said rod means being otherwise unconnected to said derrick, drive means for applying torque to said rod means, said elongated rod means being parallel to the center of said opening and center line of said derrick, driven means responsive to the torque applied to said rod means by said drive means and movable vertically on said rod means to apply torque to said drill means during vertical movement of said drilling means whereby drilling operations may be carried out through said opening, said driven means being movable vertically by the same means which moves said drilling means vertically, said driven means including first rotatable means connected to said rod means and second rotatable means connected to said first rotatable means and to said drilling means for applying torque to said drilling means, said first and second rotatable means having a drive ratio of substantially 1:1 thereby removing torque reaction from the derrick.

* * * * *